United States Patent [19]

Karlsen

[11] Patent Number: 4,493,394

[45] Date of Patent: Jan. 15, 1985

[54] BRACE LOCK FOR SCAFFOLDING

[75] Inventor: Stig Karlsen, Burlington, Wis.

[73] Assignee: Figgie International Inc., Willoughby, Ohio

[21] Appl. No.: 381,021

[22] Filed: May 24, 1982

[51] Int. Cl.[3] ..... E04G 7/22

[52] U.S. Cl. ..... 182/179; 182/178; 403/49

[58] Field of Search ..... 182/179, 178, 118, 119; 52/637, 638; 403/49; 248/544, 222.1, 326; 292/106; 24/238, 239, 241 SL

[56] References Cited

U.S. PATENT DOCUMENTS

| | | | |
|---|---|---|---|
| 112,635 | 3/1871 | Robinson | 292/106 |
| 633,765 | 9/1899 | Lowe | 24/238 |
| 812,879 | 2/1906 | Rice | 292/106 |
| 2,169,298 | 8/1939 | Sorensen | 182/142 |
| 2,392,368 | 1/1946 | Dilbert | 24/241 SL |
| 2,419,947 | 5/1947 | Foreman | 24/239 |
| 2,635,717 | 4/1953 | Albrecht et al. . | |
| 2,686,086 | 8/1954 | French . | |
| 2,716,576 | 8/1955 | Nordone . | |
| 2,726,902 | 12/1955 | Borgman et al. . | |
| 2,808,298 | 10/1957 | Meng . | |
| 2,814,535 | 11/1957 | Jagiel . | |
| 2,823,959 | 2/1958 | Pimm . | |
| 2,833,017 | 5/1958 | Dalton | 24/238 |
| 2,836,468 | 5/1958 | Jagiel . | |
| 2,841,452 | 7/1958 | Borgman et al. . | |
| 2,971,786 | 2/1961 | May . | |
| 3,017,208 | 1/1962 | Wyse . | |
| 3,027,181 | 3/1962 | Tardif . | |
| 3,043,546 | 7/1962 | Reich | 24/238 |
| 3,054,630 | 9/1962 | French . | |
| 3,122,385 | 2/1964 | Levizzani . | |
| 3,174,779 | 3/1965 | Moritz . | |
| 3,345,655 | 10/1967 | Juculano . | |
| 3,360,287 | 12/1967 | Wyse . | |
| 3,410,365 | 11/1968 | Isbell | 182/179 |
| 3,442,241 | 5/1969 | Daunis | 114/368 |
| 3,551,011 | 12/1970 | Alley . | |
| 3,730,572 | 5/1973 | Ballou | 403/49 |

*Primary Examiner*—Reinaldo P. Machado
*Assistant Examiner*—Alvin Chin-Shue
*Attorney, Agent, or Firm*—Michael, Best & Friedrich

[57] ABSTRACT

A brace lock on a scaffold for releasably engaging a perforated end of a brace. The lock comprises a pin means with an end attached to the scaffold and a free end. The pin means has a thickness and contour which permits the perforated end of the brace to pass over the pin means. The pin means includes an offset so that when the end of the brace is positioned near the attached end of the pin means, the end of the brace will not slide to the free end of the pin means unless the end of the brace is raised upwardly over the offset. The lock also includes a latch means releasably securing the end of the brace when the end of the brace is positioned near the attached end of the retaining pin means.

2 Claims, 4 Drawing Figures

BRACE LOCK FOR SCAFFOLDING

BACKGROUND OF THE INVENTION

This invention relates to locking devices on scaffolds for releasably engaging perforated ends of braces.

SUMMARY OF THE INVENTION

The principle object of this invention is to provide a brace lock which does not rely on a latch for restricting the lateral movement of a perforated end of a brace when the brace is positioned on the brace lock. By not relying on a latch, this provides a lock with greater integrity and reduces the likelihood of the lock's failure.

Another object of this invention is to provide a brace lock which is easy to manipulate and has a simple construction.

For the achievement of the above and other objectives, this invention provides a brace lock on a scaffold for releasably engaging a perforated end of a brace. The lock comprises a pin means with an end attached to the scaffold and a free end. The pin means has a thickness and contour which permits the perforated end of the brace to pass over the pin means. The pin means includes an offset so that when the end of the brace is positioned near the attached end of the pin means, the end of the brace will not slide to the free end of the pin means unless the end of the brace is raised upwardly over the offset. The lock also includes a latch means releasably securing the end of the brace when the end of the brace is positioned near the attached end of the retaining pin means.

The invention also provides a brace lock including a bent pin assuming a generally C-shaped configuration. The bent pin includes a bottom support leg. The bottom support leg has a thickness and contour which permits the perforated end of the brace to pass over the bottom support leg. The bottom support leg includes a generally U-shaped portion with a horizontal portion and two upwardly extending, spaced apart, side portions. One of the side portions is attached to the scaffold and the other side portion includes an upper end. A receiving portion is attached to the upper end of the side portion and extends laterally away from the side portion attached to the scaffold.

The bent pin also includes a top latching leg including a generally U-shaped portion with a horizontal portion and two downwardly extending, spaced apart, side portions. One of the side portions is attached to the scaffold and connected to the bottom support leg. The other side portion includes a noncircular shaft with an end positioned above and spaced away from the receiving portion, so the perforated end of the brace can pass along said bottom support leg. On the shaft is a sleeve with a lower end slidable between the receiving portion and the end of the shaft. A tab is attached to the lower end of the slidable sleeve. The tab includes a side extending upwardly away from the sleeve and the attached side portion of the top latching leg so that when the tab is engaged by the end of the brace, the brace moves the sleeve away from the receiving portion so the brace can slide along the bottom support leg.

DESCRIPTION OF THE PREFERRED EMBODIMENT

Figure 1:
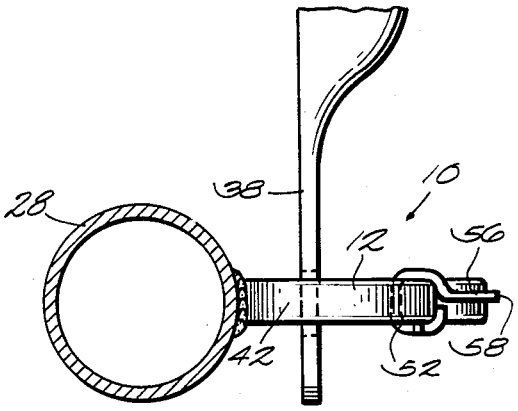
FIG. 1 is a side view of a brace lock.
Figure 4:
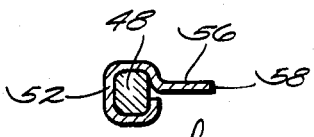
FIG. 4 is a cross section of the noncircular shaft and sleeve in FIG. 1 taken along line 4—4.
Figure 3:
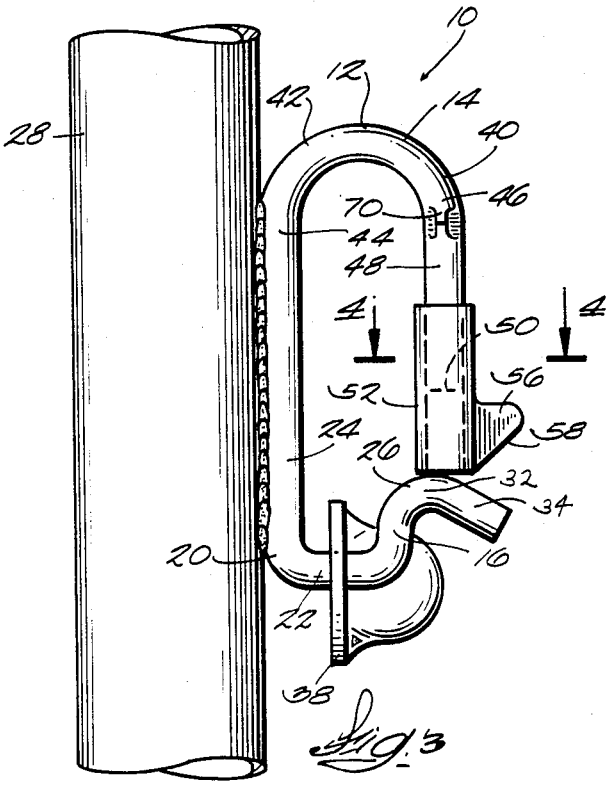
FIG. 3 is a top view of the brace lock shown in FIG. 1.
Figure 2:
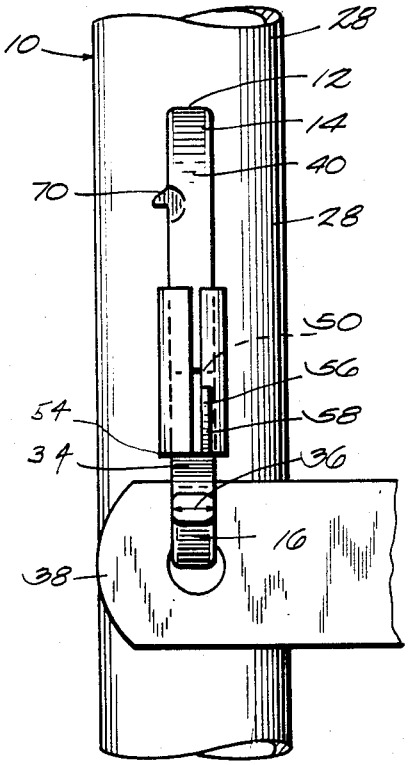
FIG. 2 is an end view of the brace lock shown in FIG. 1.

One embodiment of this invention is shown in the drawings. The brace lock 10 in FIG. 1 includes a bent pin 12 assuming a generally C-shaped configuration. The bent pin 12 includes a top latching leg 14 and a bottom support leg 16. The bottom support leg 16 includes a generally U-shaped portion 20 with a horizontal portion 22 and two upwardly extending, spaced apart, side portions 24 and 26. A side portion 24 is attached to the upright 28 of a scaffold and the other side portion 26 includes an upper end 32. A receiving portion 34 is attached to the upper end 32 of the side portion 26 and extends downwardly and laterally away from the other side portion 24. The thickness 36 and contour of the bottom support leg 16 is such that an end 38 of a brace may be placed on and then moved laterally upward along the receiving portion 34 and then rotated downward over the side portion 26 until it comes to rest in the bottom of the U-shaped portion 20. The horizontal portion 22 then absorbs vertical forces on the brace and the upwardly extending side portions 24 and 26 absorb the horizontal forces on the brace.

The top latching leg 14 includes a generally U-shaped portion 40 with a horizontal portion 42 and two downwardly extending, spaced apart, side portions 44 and 46. One of the side portions 44 is attached to the scaffold upright 28 and is a continuation of the side portion 24 of the bottom support leg 16. These two attached side portions 44 and 24 thus form one continuous side portion of the brace lock.

The other side portion 46 of the top latching leg 14 includes a vertical noncircular shaft 48 with an end 50 positioned above and spaced away from the horizontal receiving portion 34. The spacing between the end 50 of the noncircular shaft 48 and the receiving portion 34 permits the perforated end 38 of the brace to pass along the bottom support leg 16 without contacting the end 50 of vertical shaft 48.

Slidable on the vertical shaft 48 is a sleeve 52. The sleeve 52 has a lower end 54 which slides between a position adjacent the receiving portion 16 and a position adjacent the end 50 of the shaft 48. The shaft 48 and sleeve 52 are noncircular and conform to each other so the sleeve 52 is prevented from turning on the shaft 48.

Attached to the lower end 54 of the slidable sleeve 52 is a tab 56. The tab 56 includes a side or cam surface 58 extending upwardly away from the sleeve 52 and the attached side portion 44 of the top latching leg 14. This side 58 of the tab 56 is engaged by the end 38 of the brace, when the brace contacts the brace lock 10 and this causes the sleeve 52 to move upwardly. After the end 38 of the brace has moved along the bottom support leg 16, the sleeve 52 drops down to near the receiving portion 34 under the influence of gravity. The lowered sleeve 52 prohibits the end 38 of the brace from being extracted from the brace lock 10 without an operator having to move the sleeve 52 into a raised position. The upward movement of the sleeve 52 is restricted by the abutment 70.

The downward taper of the receiving portion 34 helps keep the perforated end 38 of the brace from inadvertently lifting the sleeve 52.

It is to be understood that the invention is not confined to the particular construction and arrangement of parts herein illustrated and described but embraces all such modified forms thereof as come within the scope of the following claims.

I claim:

1. A locking device for a scaffold brace comprising:

a generally C-shaped member 10 having a vertical leg 24 for attachment to a scaffold member, a lower U-shaped support portion having two upwardly extending vertical legs for supporting the scaffold brace thereon with the end of one support leg connected to the lower end of said vertical leg, a scaffold brace receiving end 34 extending horizontally and downward from the end of the other leg of said U-shaped support portion to facilitate the mounting of the scaffold brace onto said locking device, and an upper leg 12 connected to the upper end of said vertical leg and having a vertically depending latch retaining portion 48 on the end thereof positioned directly above said brace receiving end; and a latch member 52 slidably mounted on said latch retaining portion and movable between a scaffold brace blocking position and a scaffold brace non-blocking position, said latch member having a tab member thereon to facilitate manual actuation thereof, said tab member having a cam surface thereon which cooperates with a scaffold brace when the brace is inserted onto said scaffold brace receiving end to thereby facilitate mounting the brace onto the locking device.

2. A locking device according to claim 1 in which said latch retaining portion and said latch member have noncircular cross-sections so that said latch member will not rotate on said latch retaining portion.

* * * * *